US005261829A

United States Patent [19]

Fusselman et al.

[11] Patent Number: 5,261,829

[45] Date of Patent: Nov. 16, 1993

[54] CONNECTORS WITH GROUND STRUCTURE

[76] Inventors: David F. Fusselman, 717 E. Main St., Middletown, Pa. 17057; Peter K. Townsend, 416 Black Latch La., Camp Hill, Pa. 17011

[21] Appl. No.: 768,799

[22] Filed: Sep. 27, 1991

Related U.S. Application Data

[62] Division of Ser. No. 536,855, Jun. 8, 1990, abandoned.

[51] Int. Cl.[5] ..... H01R 4/66

[52] U.S. Cl. ..... 439/108; 439/608

[58] Field of Search ..... 439/79, 80, 81, 607-610, 439/92, 581

[56] References Cited

U.S. PATENT DOCUMENTS

| | | | |
|---|---|---|---|
| 4,451,107 | 5/1984 | Dola et al. | 339/143 |
| 4,568,134 | 2/1986 | DeMondi | 339/17 |
| 4,571,014 | 2/1986 | Robin et al. | 439/608 |
| 4,601,527 | 7/1986 | Lemke | 339/14 |
| 4,611,867 | 9/1986 | Ichimura et al. | 439/608 |
| 4,624,515 | 11/1986 | Brush, Jr. et al. | 439/608 |
| 4,655,518 | 4/1987 | Johnson et al. | 339/17 |
| 4,686,607 | 8/1987 | Johnson | 361/413 |
| 4,710,133 | 12/1987 | Lindeman | 439/92 |
| 4,806,107 | 2/1989 | Arnold et al. | 439/79 |
| 4,824,383 | 4/1989 | Lemke | 439/108 |
| 4,836,791 | 6/1989 | Grabbe et al. | 439/79 |
| 4,840,573 | 6/1989 | Seidel et al. | 439/92 |
| 4,846,727 | 7/1989 | Glover et al. | 439/608 |
| 4,867,690 | 9/1989 | Thumma | 439/79 |
| 4,869,677 | 9/1989 | Johnson et al. | 439/80 |
| 4,898,546 | 2/1990 | Elco et al. | 439/608 |
| 4,952,172 | 8/1990 | Barkus et al. | 439/532 |
| 4,959,024 | 9/1990 | Czeschka | 439/607 |

FOREIGN PATENT DOCUMENTS

| | | | |
|---|---|---|---|
| 0273589 | 7/1988 | European Pat. Off. . | |
| 0365179 | 4/1990 | European Pat. Off. . | |
| 3904461 | 9/1990 | Fed. Rep. of Germany | 13/658 |

*Primary Examiner*—Larry I. Schwartz
*Assistant Examiner*—Hien D. Vu
*Attorney, Agent, or Firm*—Woodcock Washburn Kurtz Mackiewicz & Norris

[57] ABSTRACT

The present invention relates to electrical connectors with a ground structure for impedance and cross talk control between signal carrying conductors.

6 Claims, 4 Drawing Sheets

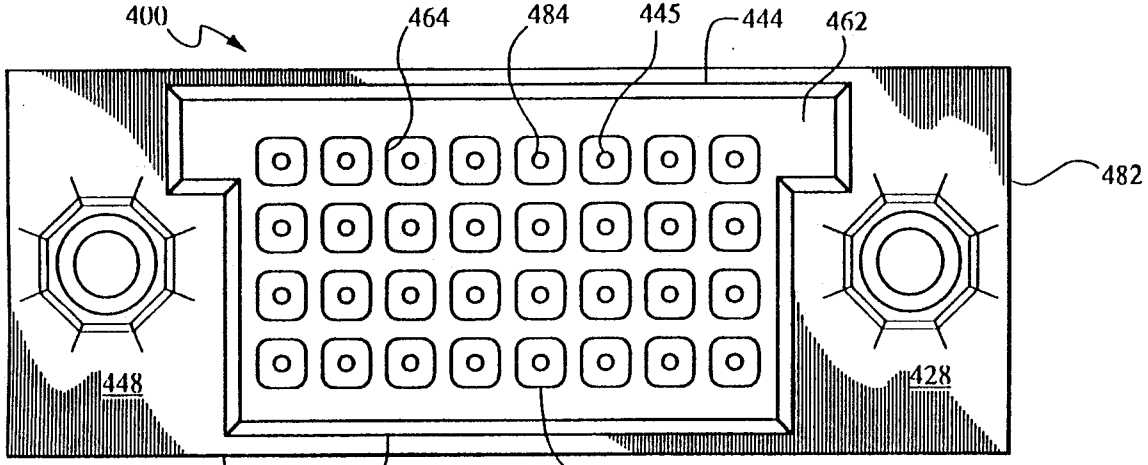
FIG. 2
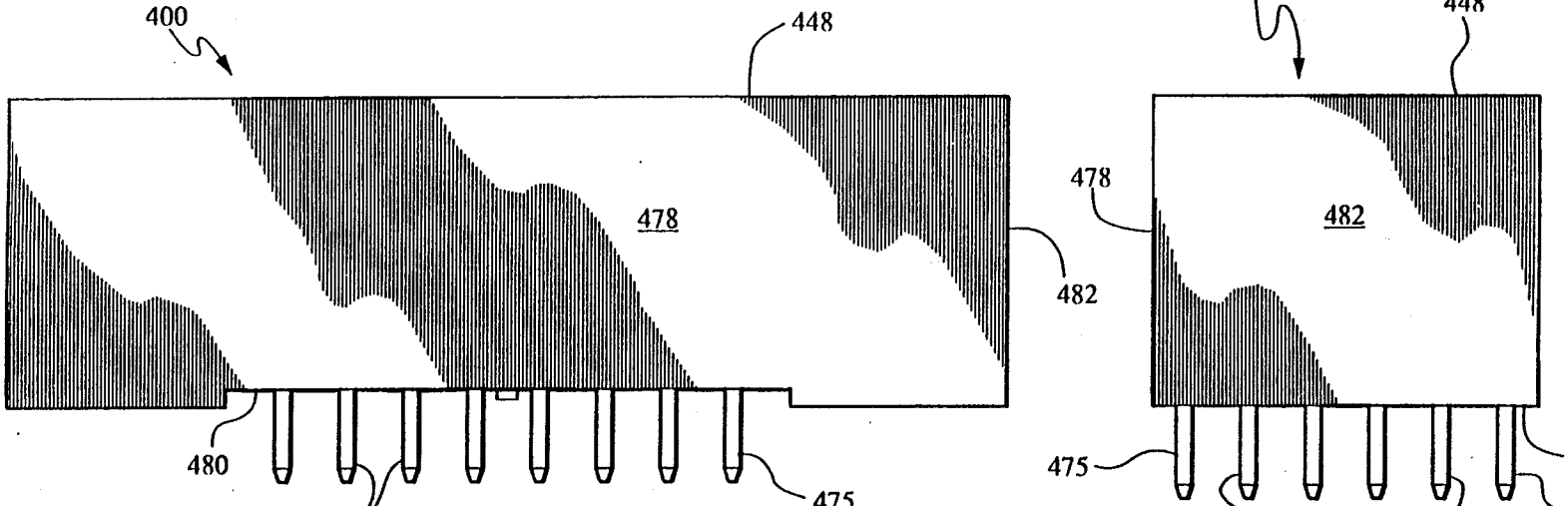
FIG. 5
FIG. 4

CONNECTORS WITH GROUND STRUCTURE

CROSS REFERENCE TO RELATED APPLICATION

This is a divisional application of copending U.S. patent application Ser. No. 07/536,855 filed Jun. 8, 1990 now abandoned.

BACKGROUND OF THE INVENTION

1. Field of the Invention

This invention relates to electrical connectors with a ground structure for impedance and cross talk control between signal carrying conductors.

2. Description of Related Art

With the advance of technology, a high density of electronic circuits and components can be located on a printed wiring board or printed circuit board (PCB). Along with this miniaturization of electronic circuits and components, electrical connectors are needed to electrically and mechanically interconnect one PCB, such as a back panel or mother board, to one or more other PCBs, such as daughter boards. Further, it is typically desirable for such connectors to have a high signal density capacity. That is, the connectors should permit a high number of signals to pass through the connector per unit volume of the connector. However, electrical signals carried on a conductor can interfere with a signal carried on an adjacent conductor.

This interfering electrical effect that an electrical signal carried on a given conductor exerts on a signal carried on an adjacent conductor is referred to as "cross talk." Controlling this cross talk is especially important in high density connectors. Such control can be implemented in a variety of ways.

One method of controlling cross talk is to connect certain terminals in a high density connector to conductive areas of a printed circuit board that are in turn grounded or connected to a predetermined ground potential. This solution is external to the connector.

U.S. Pat. Nos. 4,655,518 (to Lennart B. Johnson et al.), No. 4,686,607 (to Lennart B. Johnson) and No. 4,869,677 (to Lennart B. Johnson et al.) disclose a daughter board/backplane assembly with contact elements dedicated for grounding purposes. Header contact elements have contacts that can be connected to ground or a predetermined potential on a backplane. The header contact elements have other spring contacts carried by an inside header wall for touching contacts carried by a right angle receptacle outer wall. Other contacts are integral with and perpendicular to the contacts carried by the right angle receptacle outer wall for connection to the daughter board.

U.S. Pat. No. 4,601,527 issued to Timothy A. Lemke discloses an internal shielding structure for connectors, specifically in vertical and right angle headers. The shielding structure includes a ground strip affixed to a mating surface of a header housing. The shielding structure further includes an elongated conductive spring contact with contact beams that extend in holes of side walls of the housing, lock tabs that connect to the ground strip and ground bars for connection to a grounded chassis.

U.S. Pat. No. 4,824,383 issued to Timothy A. Lemke discloses a shielding structure in connectors or plug-type terminators for either a multiple conductor cable or a multiple tracing substrate that electrically isolates individual or groups of contact elements in the terminator to prevent or minimize cross talk between adjacent conductors and to prevent or minimize degradation of signal transmission. The terminator includes a ground structure with generally U-shaped channels. Contact elements extend into the channels. The ground structure is connected to a predetermined potential, rather than dedicating some of the contact elements for this purpose.

U.S. Pat. No. 4,898,546 issued to Richard A. Elco et al. discloses a ground shield device for right angle connectors. A different one of the shield devices straddles alternate columns of contact elements in the connector. Each shield device clips to a tail of one of the contact elements straddled by the shield device. The shield devices are connected to ground or a predetermined potential.

It is an object of this invention to provide high density electrical connectors for electrically and mechanically interconnecting electronic circuits and/or components controlling impedance and/or cross talk within the connectors.

Furthermore, it is an object of this invention to provide high density electrical connectors for electrically and mechanically interconnecting a circuit assembly and a plurality of terminals arranged in rows and columns in a mating connector to control impedance and/or cross talk thereby to reduce, prevent or minimize degradation of signal transmission within the receptacles.

SUMMARY OF THE INVENTION

The present invention is directed to an electrical connector for electrically and mechanically interconnecting a circuit assembly having a plurality of contact regions and a mating connector having first side walls, a plurality of contact portions arranged in rows and columns within the first side walls and at least one side contact portion, the electrical connector comprising:

a plurality of electrical contact elements, each of the contact elements having a first contact and a second contact, a housing including:

an insulative base having a plurality of passages arranged in rows and columns extending through the base, one of the contact elements fixed in each of the passages with the first contacts positioned on a first side of the base in a contact region for contacting one of the contact portions and the second contacts positioned on a second side of the base, and conductive side walls, the base and the conductive side walls partially enclosing the contact region, the conductive side walls comprising at least one third contact for contacting the at least one side contact portion; and at least one ground contact extending from the conductive side walls such that the second contacts and the ground contacts are arranged in rows and columns for connecting to the contact regions of the circuit assembly.

BRIEF DESCRIPTION OF THE DRAWINGS

The invention can be more fully understood from the following detailed description thereof in connection with accompanying drawings which form a part of this application and in which:

FIG. 2 is an enlarged view of a top or first mating side of the high density vertical connector of FIG. 1.

FIG. 4 is an enlarged view of a front side of the vertical connector of FIG. 1.

FIG. 5 is an enlarged view of an end of the vertical connector of FIG. 1.

DESCRIPTION OF THE PREFERRED EMBODIMENT(S)

Figure 1:
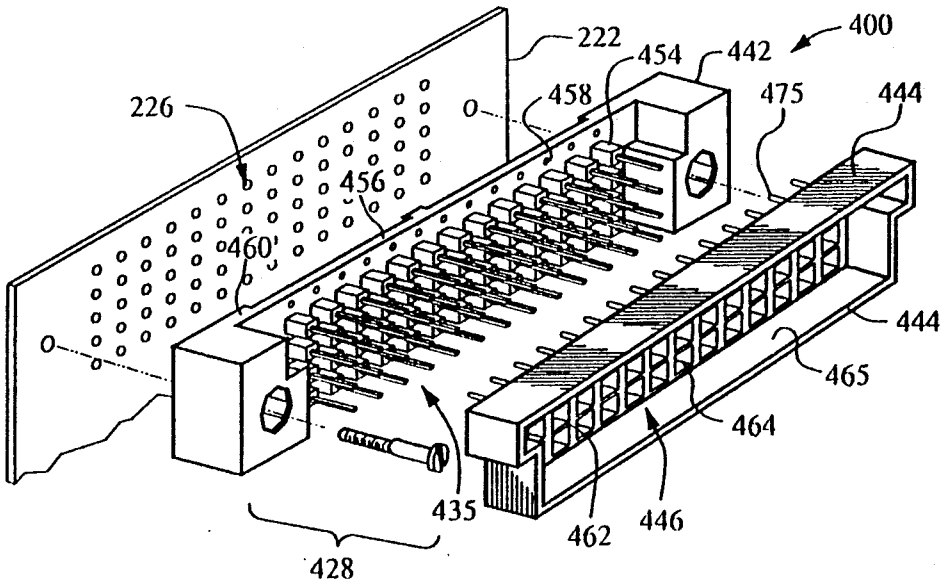
FIG. 1 is an exploded perspective view of a high density connector assembly in accordance with the present invention, the assembly including a high density vertical connector for interconnecting a circuit assembly and a mating connector.

Throughout the following detailed description, similar reference characters refer to similar elements in all figures of the drawings.

Referring to FIG. 1, there is illustrated an exploded perspective view of a high density connector assembly in accordance with the present invention. The assembly includes a high density vertical connector or header 400 for interconnecting a circuit assembly 222 and a mating connector (not depicted). Specifically, the high density vertical header 400 is for interconnecting the circuit assembly 222 having a plurality of contact areas 226 and a mating receptacle including a plurality of terminals with a plurality of first contact portions arranged in rows and columns in a receptacle housing, the receptacle further including at least one second side contact portions. Suitable connectors that can be used for mating with the connector 400 of the present invention are disclosed in U.S. patent application Ser. No. 07/536,855 filed Jun. 8, 1990 now abandoned, which is hereby incorporated by reference.

Figure 3:
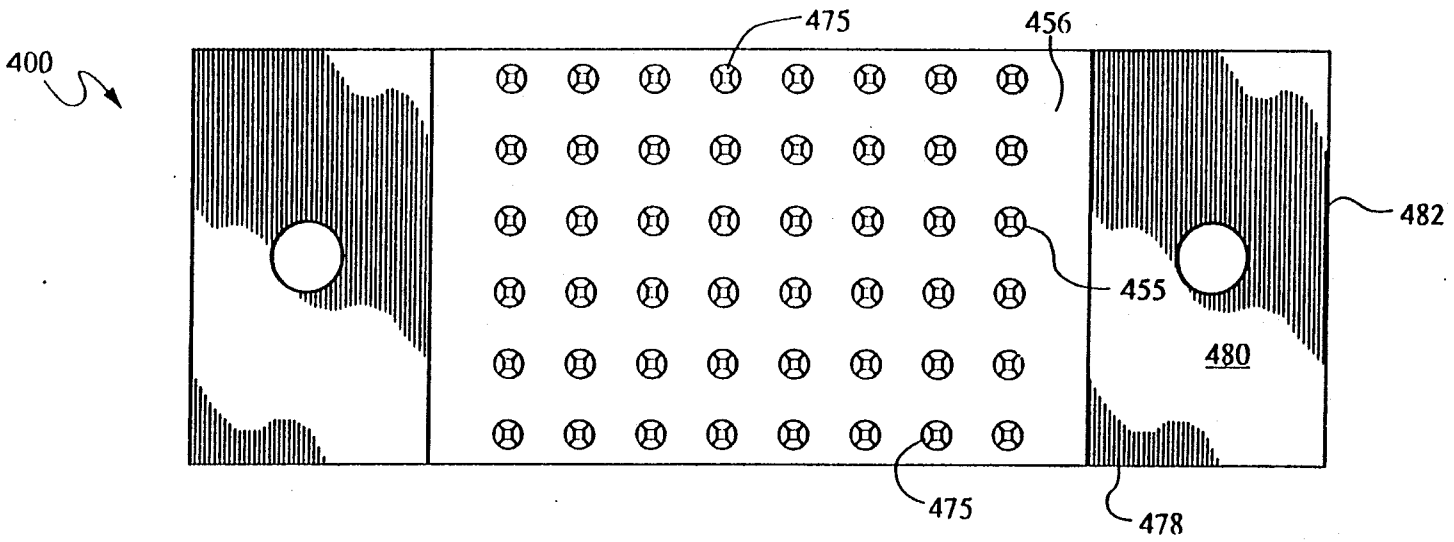
FIG. 3 is an enlarged view of a bottom or second mating side of the vertical connector of FIG. 1.
Figure 6:
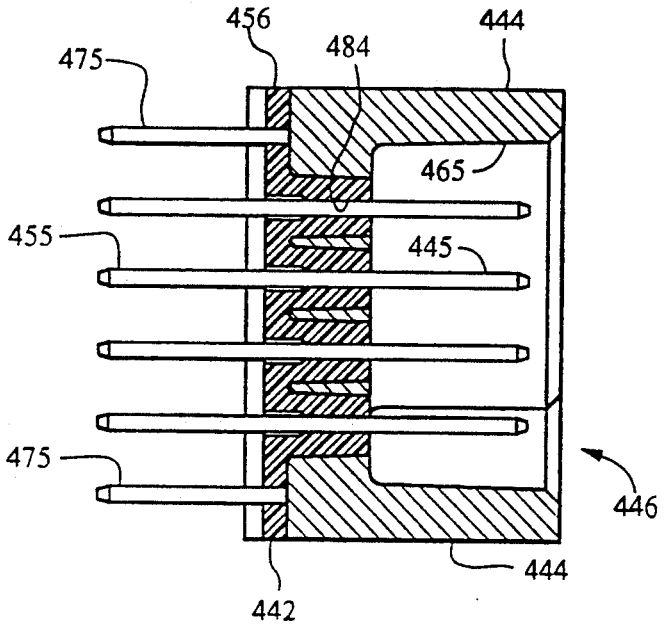
FIG. 6 is a sectional view of the vertical connector of FIGS. 1-5.

FIG. 2 is an enlarged view of a top or first mating side 448 of the high density vertical header 400 of FIG. 1. FIG. 3 is an enlarged view of a bottom or second mating side 480 of the vertical header 400 of FIG. 1. FIG. 4 is an enlarged view of a front side 478 of the vertical header 400 of FIG. 1. FIG. 5 is an enlarged view of an end 482 of the vertical header 400 of FIG. 1. FIG. 6 includes an enlarged cross sectional view of the header 400.

The vertical header 400 comprises a housing 428 including an insulative base 442 and conductive side walls 444; a plurality of conductive electrical contact elements 435 mounted in the base 442; and at least one ground contact 475 extending from the conductive side walls 444.

The conductive electrical contact elements 435 may have any configuration so long as they are useable as vertical contact elements. In other words, they may be male elements, female elements or gender neutral. More specifically, each one of the electrical contact elements 435 has a first contact 445 and a second contact 455. Preferably, the first contacts 445 and the second contacts 455 are distal end portions of a pin generally having a 0.24 inches by 0.24 inches square cross section. One of the contact elements 435 is fixed in each passage 484 through the base 442 with the first contacts 445 positioned in a contact region 446 for contacting one of the first contacts of a mating receptacle. The first contacts 445 are generally parallel to one another and arranged in rows and columns. There can be any number of rows and any number of columns of the first contacts 445. However, there are preferably at least two rows and at least two columns. Typically, there are three, four, five or six rows of the first contacts 445. The Figures depict four rows of the first contacts 445. Typically, there are many columns of the first contacts 445. Preferably, each one of the first contacts 445 is generally colinear or parallel to the second contacts 455. The second contacts 455 can be through mount contacts or surface mount contacts.

Referring to FIG. 6, the insulative base 442 has a plurality of passages 484 arranged in rows and columns extending through the base 442. One of the contact elements 435 is fixed in each of the passages 484 with the first contacts 445 positioned on a first side of the base 442 in the contact region 446 for contacting one of the first contact portions arranged in rows and columns in a mating connector. The second contacts 455 are positioned on a second side of the base 442 for contacting the second side contact portions of a mating connector. Referring to FIG. 1, the base 442 may comprise an insulative sleeve 454 surrounding each of the contact elements 435. The sleeves 454 may be connected to and extend from an insulative layer 456. The ground contacts 475 may extend through holes 458 in edge portions 460 of the insulative layer 456.

Referring again to FIG. 6, the conductive side walls 444 comprise at least one third contact 465 for contacting side contacts on one of the side walls of a mating connector. The third contacts 465 may be on interior surfaces of the side walls 444 or exterior surfaces of the side walls 444. In one embodiment, opposing interior surfaces of the conductive side walls 444 comprise the third contacts 465. The base 442 and the conductive side walls 444 partially enclose the contact region 446. The conductive side walls 444 may contact and extend generally perpendicularly to the edge portions 460 of the insulative layer 456. At least one ground contact 475 extends from the conductive side walls 444 such that the second contacts 455 and the ground contacts 475 are arranged in rows and columns for connecting to the contact regions 226 of the circuit assembly 222. Preferably, a plurality of the ground contacts 475 extend from each one of the opposing side walls 444. Preferably, the ground contacts 475 are pin shaped. The ground contacts 475 can have the same or a different shape than the second contacts 455. For instance, both the second contacts 455 and the ground contacts 475 can be pin shaped, but the cross section of one of them, such as the ground contacts 475 can be larger than the cross section of the other. The ground contacts 475 can be integrally cast out of the same metal with the side walls 444. Alternatively, the ground contacts 475 can be conductive pins secured in holes in or through the side walls 444.

Referring to FIGS. 1, 2 and 6, the housing 428 may further comprise a conductive base or lattice 462 connected to and extending between the conductive side walls 444. The lattice 462 may be generally perpendicular to the conductive side walls 444. The lattice 462 has a plurality of passages 464 surrounding each of the contact elements 435. The sleeves 454 can be in the passages 464 of the lattice 462.

The first contacts 445 of the high density header 400 can connect to any connector having a plurality of terminals or contact elements with a plurality of first contact portions arranged in rows and columns with at least one second side contact portion for engaging at least one of the third contacts 465. The receptacle that is mateable with the header 400 can be a vertical receptacle or an angled or right angle receptacle. Preferably, the terminals of the receptacle that is mateable with the header 400 have socket shaped contact portions for engaging the first contacts 445 of the header 400.

The circuit assembly 222 can be any assembly that includes a plurality of conductors, leads, plated through holes or conductive paths, pads or areas 226. The circuit assembly 222 can be a printed wiring board or a printed circuit board, such as a backpanel, a mother board or a daughter board. The circuit assembly 222 can be a cable assembly. The circuit assembly 222 can be rigid or flexible. In one typical situation, the header 400 is for electrically and mechanically interconnecting a backpanel or mother board 222 and a mating receptacle which, in turn, is for electrically and mechanically connecting to a daughter board that is perpendicular to the mother board 222.

It will be recognized by those skilled in the art that the ground structure of the present invention can be modified to be used on any angled receptacle or header where the two contacts of the contact elements of the receptacle or header are at an angle other than 180 degrees from one another.

The parts referred to throughout this specification can be made from known materials used to make similar conventional parts. For instance, the insulative housings can be made of various plastics, such as polyetherimide resin or polyphenylene sulfide resin. The conductive walls, conductive bases, baffles and shields can be made of any nonmagnetic metal or metal alloy including zinc, aluminum, copper, brass or alloys thereof. The contact elements of the present invention can be made from any suitable metal used for electrical terminals, such as brass, phosphor bronze, beryllium copper and the like. The contact elements may be plated or coated with a conductive layer, such as tin, nickel, palladium, gold, silver or a suitable alloy.

Those skilled in the art, having the benefit of the teachings of the present invention as hereinabove set forth, can effect numerous modifications thereto. These modifications are to be construed as being encompassed within the scope of the present invention as set forth in the appended claims.

What is claimed is:

1. An electrical connector for electrically and mechanically interconnecting a circuit assembly having a plurality of contact regions and a mating connector having first side walls, a plurality of contact portions arranged in rows and columns within the first side walls and at least one side contact portion, the electrical connector comprising:

a plurality of electrical contact elements, each of the contact elements having a first contact and a second contact, a housing including:

a single piece insulative base comprising an insulative layer and a plurality of insulative sleeves extending from the insulative layer, a plurality of passages arranged in rows and columns extending through the base, one of the passages extending through each of the sleeves, one of the contact elements fixed in each of the passages with the first contacts positioned on a first side of the base in a contact region for contacting one of the contact portions and the second contacts positioned on a second side of the base, exterior conductive side walls, the base and the conductive side walls partially enclosing the contact region, the conductive side walls comprising at least one third contact for contacting the at least one side contact portion, and a conductive lattice connected to and extending between the conductive side walls, the lattice generally perpendicular to the conductive side walls, the lattice having a plurality of passages through which the sleeves extend, the lattice and conductive side walls being a single structure; and at least one ground contact extending from the conductive side walls such that the second contacts and the ground contacts are arranged in rows and columns for connecting to the contact regions of the circuit assembly.

2. The electrical connector of claim 1, wherein the ground contacts extend through holes in edge portions of the insulative layer.

3. The electrical connector of claim 1, wherein the conductive side walls contact and extend generally perpendicularly to edge portions of the insulative layer.

4. The electrical connector of claim 1, wherein the electrical connector is a header.

5. The electrical connector of claim 1, wherein the at least one third contact is on an interior surface of one of the conductive side walls.

6. The electrical connector of claim 1, wherein opposing interior surfaces of the conductive side walls comprise the third contacts.

* * * * *